US008537057B2

(12) United States Patent
Friederich et al.

(10) Patent No.: US 8,537,057 B2
(45) Date of Patent: Sep. 17, 2013

(54) MOBILE TERMINAL WITH TWO ANTENNAS FOR REDUCING THE RF RADIATION EXPOSURE OF THE USER

(75) Inventors: Alexander Friederich, Aalborg (DK); Ole Jagielski, Frederikshavn (DK); Sinan Köksoy, Aalborg Ost (DK); Simon Svendsen, Aalborg Ost (DK)

(73) Assignee: Palm, Inc., Sunnyvale, CA (US)

( * ) Notice: Subject to any disclaimer, the term of this patent is extended or adjusted under 35 U.S.C. 154(b) by 184 days.

(21) Appl. No.: 12/914,738

(22) Filed: Oct. 28, 2010
(Under 37 CFR 1.47)

(65) Prior Publication Data

US 2011/0304512 A1 Dec. 15, 2011

Related U.S. Application Data

(63) Continuation of application No. 12/306,555, filed as application No. PCT/EP2007/056300 on Jun. 25, 2007, now abandoned.

(30) Foreign Application Priority Data

Jun. 30, 2006 (EP) ..... 06116453

(51) Int. Cl.

| | |
|---|---|
| ***H01Q 21/00*** | (2006.01) |
| ***H01Q 1/50*** | (2006.01) |
| ***H01Q 1/42*** | (2006.01) |
| ***H01Q 1/40*** | (2006.01) |

(52) U.S. Cl.
USPC ..... 343/702; 343/853; 343/860; 343/872; 343/873; 343/893

(58) Field of Classification Search
USPC ..... 343/702, 853, 860, 872, 873, 893
See application file for complete search history.

(56) References Cited

U.S. PATENT DOCUMENTS

| | | | | |
|---|---|---|---|---|
| 7,146,139 | B2 * | 12/2006 | Nevermann | 455/115.1 |
| 2003/0016178 | A1 * | 1/2003 | Byun et al. | 343/702 |
| 2007/0052589 | A1 * | 3/2007 | Liu | 343/700 MS |
| 2007/0146210 | A1 * | 6/2007 | Hilgers | 343/702 |

* cited by examiner

*Primary Examiner* — Jacob Y Choi
*Assistant Examiner* — Graham Smith

(57) ABSTRACT

For a mobile terminal for receiving wireless transmissions from a transmitter and transmitting wireless transmissions to a receiver it proposed to provide an antenna arrangement having a plurality of antenna elements each provided on or within a common body or a respective body of the terminal in a defined spatial relation to a conducting chassis part, wherein at least one first antenna element is located on a first side and at least one second antenna element is located on a second side of the same conductive chassis part or of the respective conducting chassis part, wherein high frequency circuitry, for transmitting a respective wireless transmission, is adapted to simultaneously drive said first antenna element and said second antenna element by feeding the same or corresponding high frequency signals to said first antenna element and to said second antenna element.

13 Claims, 6 Drawing Sheets

PRIOR ART

MOBILE TERMINAL WITH TWO ANTENNAS FOR REDUCING THE RF RADIATION EXPOSURE OF THE USER

CROSS REFERENCES TO RELATED APPLICATIONS

This present application is a continuation of U.S. application Ser. No. 12/306,555 filed Dec. 24, 2008 now abandoned, which is a National Stage of International Application No. PCT/EP2007/056300 filed on Jun. 25, 2007, of which claims priority to European Patent Application No. 06116453.9 filed on Jun. 30, 2006, the entire contents of which are hereby incorporated by reference.

BACKGROUND

The invention relates to a mobile terminal for receiving wireless transmissions from a transmitter and transmitting wireless transmissions to a receiver, in particular for use in a wireless telecommunication system, comprising: a casing with at least one body, said body having a conducting chassis part and electronic means preferably including at least one element of the group consisting of a control element arrangement, at least one display element, a microphone, a speaker arrangement, electronic circuitry, high frequency circuitry and a storage battery, said body further having a first surface located on a first side of its conducting chassis part and a second surface located on a second side of its conducting chassis part, the control element arrangement and the display element, if provided, being accommodated in a respective surface of the body and the electronic circuitry, the high frequency circuitry and the storage battery, if provided, being arranged within the respective body; and an antenna arrangement provided on or within said body, said antenna arrangement together with associated high frequency circuitry or said antenna arrangement together with said conducting chassis part and associated high frequency circuitry being adapted to receiving wireless transmissions and transmitting wireless transmissions in at least one predetermined frequency band. In particular it is referred to mobile phones and other mobile terminals of the so-called mono-block or brick type.

The invention further relates to mobile terminal for receiving wireless transmissions from a transmitter and transmitting wireless transmissions to a receiver, in particular for use in a wireless telecommunication system, comprising: a casing with a first body and a second body, each body having a conducting chassis part and electronic means preferably including at least one element of the group consisting of a control element arrangement, at least one display element, a microphone, a speaker arrangement, electronic circuitry, high frequency circuitry and a storage battery, each body having a first surface located on a first side of its conducting chassis part and a second surface located on a second side of its conducting chassis part, the control element arrangement and the display element, if provided, being accommodated in a respective surface of the body and the electronic circuitry, the high frequency circuitry and the storage battery, if provided, being arranged within the respective body; a relative movement mechanism linking the first body and the second body and allowing a relative movement between the two bodies between a plurality of operational relative positions, wherein at least in a closed operational relative position the second surface of the first body faces and covers at least partially the first surface of the second body; and an antenna arrangement provided on or within at least one associated of said bodies, said antenna arrangement together with associated high frequency circuitry or said antenna arrangement together with said conducting chassis part and associated high frequency circuitry being adapted to receiving wireless transmissions and transmitting wireless transmissions in at least one predetermined frequency band. In particular it is referred to mobile phones and other mobile terminals of the so-called slider type or of the so-called clam-shell type or folder type.

SUMMARY

The specific absorption rate (SAR) is currently the standard measure for assessing human exposure to radiofrequency electromagnetic fields (RFEMF). The internationally binding safety limits, which are recommended and enforced in order to protect the population from excessive electromagnetic exposure, are defined in terms of SAR. Consequently, mobile units are required to have their SAR values below the safety limits before they may be offered to the end-users.

Typically, the front side of mobile phones contains a major part of the user-interface elements, such as display, speaker, microphone, and input units including keys and buttons and the like. This side of the mobile phone is commonly referred to as the "display side" of the phone, whereas the back part, which is the opposite side, is referred to as the "antenna side", due to the fact that internal GSM antennas are placed in most cases on the back side of the terminal.

The abovementioned two sides are separated by the phone chassis, which can be identified as the combination of conductive parts found within the handset, such as the printed circuit board (PCB) or the printed wire board (PWB) of the phone as well as shielding units and other elements alike.

Due to the fact that with most mobile phones known from the art, the head of the user faces the display side of the mobile phone in a normal talk position, there have been proposed many different solutions for the reduction of user exposure and thus the SAR values, for this particular usage scenario. However, the majority of these techniques are based on controlling the strength and behaviour of the near-fields at this side of the phone; therefore, they have limited or no impact on other usage scenarios where the mobile phone is situated in a different position close to or on the human body, such as for the case in which the antenna is extremely close to the body and the like.

Some of the earlier approaches for reducing user exposure to RFEMF and thereby reducing the SAR values, such as the use of specific magnetic materials, such as ferrites, or the use of wave-absorbing materials, may also help for different possible user-scenarios as outlined above. However, these approaches are known to have high losses, and result in the deterioration of the radiation performance, in addition to increasing the cost of manufacturing.

EP1109247 A1 describes an antenna arrangement comprising two or more antennas with a different radiation pattern in the near field and a control device for switching between the different antennas so that they are only operated half or a certain portion of the time. For this purpose, simply a power splitter or a switch is used. Accordingly, with the use of two antennas the SAR value can be reduced up to 50% and by use of three antennas up to 67%. This multiple antenna approach, however, is based on an assumed user behavior including the tendency to hold the mobile telephone always in the same way. As a consequence, this approach is not helpful for usage scenarios where not only the display side of the phone, but also the antenna side of the phone faces the human body. Besides, the control circuitry to be provided for the operation of the two antennas increases the production costs significantly.

It is an object of the invention to provide a mobile terminal of the above-referenced types which allows to provide for relatively low SAR values irrespectively of a current operation position of a number of different possible operating positions. Preferably, this object is achieved on basis of a very simple structure.

The object of the invention is achieved by a mobile terminal for receiving wireless transmissions from a transmitter and transmitting wireless transmissions to a receiver, in particular for use in a wireless telecommunication system, comprising: a casing with at least one body, said body having a conducting chassis part and electronic means preferably including at least one element of the group consisting of a control element arrangement, at least one display element, a microphone, a speaker arrangement, electronic circuitry, high frequency circuitry and a storage battery, said body further having a first surface located on a first side of its conducting chassis part and a second surface located on a second side of its conducting chassis part, the control element arrangement and the display element, if provided, being accommodated in a respective surface of the body and the electronic circuitry, the high frequency circuitry and the storage battery, if provided, being arranged within the respective body; and an antenna arrangement provided on or within said body, said antenna arrangement together with associated high frequency circuitry or said antenna arrangement together with said conducting chassis part and associated high frequency circuitry being adapted to receiving wireless transmissions and transmitting wireless transmissions in at least one predetermined frequency band.

According to the invention said antenna arrangement has a plurality of antenna elements each provided on or within an associated of said bodies in a defined spatial relation to its conducting chassis part, wherein at least one first antenna element is located on the first side of the conducting chassis part of the first body and at least one second antenna element is located on the second side of the conducting chassis part of the first body or of the second body, wherein said high frequency circuitry, for transmitting a respective wireless transmission, is adapted to simultaneously drive said first antenna element and said second antenna element by feeding the same or corresponding high frequency signals to said first antenna element and to second antenna element.

This object of the invention is further achieved by a mobile terminal for receiving wireless transmissions from a transmitter and transmitting wireless transmissions to a receiver, in particular for use in a wireless telecommunication system, comprising: a casing with a first body and a second body, each body having a conducting chassis part and electronic means preferably including at least one element of the group consisting of a control element arrangement, at least one display element, a microphone, a speaker arrangement, electronic circuitry, high frequency circuitry and a storage battery, each body having a first surface located on a first side of its conducting chassis part and a second surface located on a second side of its conducting chassis part, the control element arrangement and the display element, if provided, being accommodated in a respective surface of the body and the electronic circuitry, the high frequency circuitry and the storage battery, if provided, being arranged within the respective body; a relative movement mechanism linking the first body and the second body and allowing a relative movement between the two bodies between a plurality of operational relative positions, wherein at least in a closed operational relative position the second surface of the first body faces and covers at least partially the first surface of the second body; and an antenna arrangement provided on or within at least one associated of said bodies, said antenna arrangement together with associated high frequency circuitry or said antenna arrangement together with said conducting chassis part and associated high frequency circuitry being adapted to receiving wireless transmissions and transmitting wireless transmissions in at least one predetermined frequency band.

According to the invention said antenna arrangement has a plurality of antenna elements each provided on or within an associated of said bodies in a defined spatial relation to its conducting chassis part, wherein at least one first antenna element is located on the first side of the conducting chassis part of the first body and at least one second antenna element is located on the second side of the conducting chassis part of the first body or of the second body, wherein said high frequency circuitry, for transmitting a respective wireless transmission, is adapted to simultaneously drive said first antenna element and said second antenna element by feeding the same or corresponding high frequency signals to said first antenna element and to second antenna element.

The relative movement mechanism may comprise an hinge arrangement effective between the two bodies, allowing a swiveling or folding movement of the two bodies with respect to each other between the closed operational position and an open operational relative position in which the two surfaces both are uncovered. Alternatively or additionally, the relative movement mechanism may comprise a shifting or sliding arrangement effective between the two bodies, allowing a shifting or sliding movement of the two bodies with respect to each other between the closed operational relative position and an open operational position in which the two surfaces both are uncovered or both have a major uncovered portion.

The mobile terminal, e.g. mobile phone, according to the invention is disposable in at least two different operation positions with respect to a user, in which either the first side or the second side of the conducting chassis part of at least one of the conducting chassis parts is directed to the body of the user, so that in all said operation positions at least one of the antenna elements is located farther away from the body of the user than at least one other of the antenna elements. Since the conducting chassis part is located between the antenna element being located farther away from the body and the body, a certain shielding effect can be achieved with respect to said antenna element being located farther away from the body. Accordingly, by transmitting only or to a larger extend via the antenna element located farther away from the body of the user, unduly increased SAR values can be avoided for all operation positions.

Basically, the mobile terminal, e.g. mobile phone, can comprises an antenna structure having a ground element, at least a first antenna element and at least a second antenna element. The ground element is provided by the or at least one of said conducting chassis parts or can be a part of said conducting chassis part or parts. In particular, the ground element can be provided by a printed circuit board or printed wire board. According to the invention, the ground element is disposed between the first antenna element and the second antenna element in such an arrangement that in all normal operation positions the respective antenna element which is farther distant from the user in the respective operation position is substantially separated from the user by the ground element and accordingly can be used for wireless transmissions without giving rise to increased SAR values.

The first antenna element and the second antenna element can be electrically isolated from the ground element, except for a connection via a probe to the feed line for radiofrequency (RF) signal feed and reception. In particular, an inverted L antenna, preferably inverted L patch antenna (PILA) configuration can be realized for both antenna elements. However, also an inverted F antenna, preferably inverted F patch antenna (PIFA) configuration can be realized to advantage for both antenna elements. In this case there would be a grounding connection between the ground element and the respective antenna element.

The first antenna element and the second antenna element may be connected to each other directly, i.e., in parallel, or alternatively, they may be connected to each other via a matching network in between, depending on the specifics of the type of the antennas being used. The invention is restricted neither by the types of the antennas being used, nor by the way their impedance is matched to the impedance of the feeding line or feeding lines.

For the implementation of the invention it should not be ruled out to use an active concept of switching between the antenna elements for transmitting respective wireless transmissions. For example, there might be a control unit which determines on basis of certain sensors, which of the antenna elements is the antenna element farther away from the body and which controls a switching arrangement to use only that antenna element located farther away from the body for transmissions or which directs on basis of appropriate means a larger portion of the high frequency power to that antenna element which is located farther away from the body than to the other antenna element. Under free space conditions both antenna elements could be used for transmitting respective wireless transmissions and of course also for receiving respective wireless transmissions.

However, preferably a passive realization of an antenna element selection is implemented. Preferred is an embodiment, wherein the high frequency characteristics of the first and second antenna elements in said predetermined frequency band are adjusted or matched such to each other or/and to the high frequency characteristics of the high frequency circuitry that (i) under free space conditions a first substantial portion of the high frequency power associated to said wireless transmissions is radiated via the first antenna element and a second substantial portion of the high frequency power associated to said wireless transmissions is radiated via the second antenna element and that (ii) under asymmetric non free space conditions, when only a selected one of the first and second antenna elements is dielectricly (dielectrically) loaded or a selected one of the first and second antenna elements is dielectricly (dielectrically) loaded stronger than the other of the first and second antenna elements, the portion of the high frequency power associated to said wireless transmissions which is radiated via said selected antenna element is reduced with respect to the free space conditions, so that (iii) of the overall high frequency power radiated via the first and second antenna elements the relative portion which is radiated via the selected antenna element under the asymmetric non free space conditions is decreased with respect to the free space conditions.

Said asymmetric non free space conditions in particular relate to conditions under dielectric loading of said selected antenna element by the body of a user, the selected antenna element being that antenna element of said first and second antenna elements which is nearer to the body of the user depending whether the first or second side is directed to the body of the user.

Due to said arrangement, when the mobile device is placed in free space, the first antenna element and the second antenna element operate together, that is, both of them contribute to the radiation. However, when the mobile handset is placed close to a user's body in a specific position, the antenna element that is closer to the user's body undergoes dielectric loading, and hence gets de-tuned. This leads to lower surface currents to flow on the detuned antenna element, leading to weakened radiation. Conversely, the other antenna element, which is placed on the other side of the ground element, is not significantly influenced by the user's presence, due to the shielding effect of the ground element. Therefore, this element does not suffer de-tuning, and thus radiates effectively. Again, due to the presence of the ground element, which provides shielding, this antenna element radiates away from the user. Consequently, the amount of electromagnetic energy being irradiated into the user is reduced, and the corresponding SAR values are significantly lowered.

As already mentioned, the ground element considered here is constituted by a conductive part or conductive parts such as a metal plate or the like. In particular, the ground element is constituted by or comprises the chassis of the mobile device or at least one section thereof.

Preferably, said first and second antenna elements are connected in parallel with a common feeding point, directly or via a common matching network, the common feeding point preferably being provided by an output port of a common front end of said high frequency circuitry. In this respect it is further proposed that said first and second antenna elements share a common feeding line connecting the feeding point or an output port of the common matching network with a feeding junction connecting the first and second antenna elements directly or via at least one matching or adjusting network associated to a respective of the first and second antenna elements. A branching point at which the common feeding line is connected with the feeding junction may be located on the conducting chassis part having the common front end or, alternatively, may be displaced from the conducting chassis part having the common front end. The latter may serve to adjust relative electrical phases between the antenna elements.

Although the use of one common front end is preferred in view of costs and constructional space requirements, it should not be ruled out that said first and second antenna elements are connected individually with a respective first and second front end of said high frequency circuitry, directly or via a respective matching network, said front ends being operable to drive the first and second antenna elements in parallel by feeding the same or corresponding high frequency signals to said first antenna element and to second antenna element. One may even provide a respective first and second power amplifier for each of the antenna elements. Preferred is of course to use a common front end and power amplifier arrangement for the antenna elements, as already indicated.

In addition to the reduction of SAR values, the arrangement according to the invention allows significant enhancements in terms of the usable operating frequency bandwidth. This may be attributed to the use of a larger effective volume by the two antennas, as well as a smoother distribution of surface currents and electromagnetic near-fields within and around the handset and a better coupling of the antenna arrangement to the conducting chassis part or chassis parts, in particular the ground element or ground elements mentioned in the foregoing. The advantages outlined here can be obtained for the frequency band or frequency bands where the antenna arrangement with its antenna elements acts as the main radiator. This may be attributed to a direct or indirect coupling or interaction between the antenna elements. Further, these advantages can also or even more effective be achieved for the frequency band or frequency bands where the antenna elements act as a coupler which excites the conducting chassis part (ground element) or conducting chassis parts (ground elements) of the handset, which in turn becomes the main radiator. This may be attributed to the better coupling between the antenna arrangement and the conducting chassis part or chassis parts.

Consequently, it becomes possible to effectively cover multiple different cellular network frequency bands, such as the lower frequency bands GSM/EGSM (850, 900 MHz), and the higher frequency bands PCN (1800 MHz), PCS (1900 MHz), UMTS/WCDMA (2100 MHz) and the like. A further advantage resulting from the antenna structure according to the invention is an improvement in the radiated power performance of the mobile device, which may be attributed to the low Q-factor of the antenna, which in turn ensures that the strength of the electromagnetic near-fields is lower and thereby any possible thermal losses within the device are minimal.

Another benefit resulting from the antenna structure according to the invention is a possible miniaturization of the overall device. This is attributed to the improvement in the bandwidth at the lower frequency bands, where the chassis of the phone acts as the main radiator. It is known that the bandwidth of a radiating structure may decrease when its size is reduced. Therefore, reducing the size of the chassis of a handset usually leads to a reduction of bandwidth in the lower bands. However, by virtue of the invention, this may be compensated, and consequently, the chassis of the phone, which usually determines the overall size of the handset, can be made smaller.

Further, the invention allows improvements of the return loss in particular for lower frequency bands (such as GSM 850 and EGSM 900). Accordingly, the length of the chassis may be reduced further without compromising the performance. A further improvement with respect to the operational bandwidth can be achieved when the antenna elements are arranged such that they extend to a certain extent beyond the periphery of the chassis. The bandwidth's improvement results from a better coupling between the chassis and the respective antenna element. It is known that such an arrangement can cause an increase in SAR as well. However, since the maximum SAR values which can result for the user are limited according to the invention, it is possible to achieve a bandwidth improvement without too high SAR values. In particular, both SAR reduction and bandwidth improvement is possible.

In agreement with the invention is an implementation, wherein at least one preferably both of a structure and electrical characteristics of the first antenna element and of the second antenna element are substantially equal or/and wherein a first antenna volume associated to the first antenna element and a second antenna volume associated to the second antenna element are substantially equal or/and wherein a first high frequency coupling between the first antenna element and the associated conducting chassis part is substantially as strong as a second high frequency coupling between the second antenna element and the associated conducting chassis.

Also, in agreement with the invention is an implementation, wherein at least one of a structure and electrical characteristic of the first antenna element and of the second antenna element are substantially different or/and a first antenna volume associated to the first antenna element and a second antenna volume associated to the second antenna element are substantially different or/and a first high frequency coupling between the first antenna element and the associated conducting chassis part is substantially stronger or weaker than a second high frequency coupling between the second antenna element and the associated conducting chassis.

To advantage, the antenna arrangement may be provided with or have associated means to equalize or reduce a difference between electrical characteristics of the first and second antenna elements or/and the first and second high frequency coupling between the conducting chassis part and the first antenna element and the second antenna element, respectively, or/and phases of currents associated to the first and second antenna elements.

According to a preferred embodiment at least one of the antenna elements is provided in the form of a patch antenna element, wherein at least one vertical patch antenna section is provided in order to increase or decrease the coupling to the associated conducting chassis part. At least one of the antenna elements may be provided with a horizontal patch antenna section.

To advantage, at least one of the antenna elements may be provided with or may have associated a delay element or delay network in order to increase an effective electrical length relevant for the feeding and influencing the phase of currents associated to the respective antenna element.

Preferably, the first antenna element and the second antenna element are balanced with regard to their electrical characteristics. That is, the first and the second antenna element are similar, if not identical in terms of their radiation characteristics. The similarity of the radiation characteristics may be reached by having a first antenna element and a second antenna element with a substantially equal structure.

However, as already indicated, the antenna structure according to the invention is not limited to such a configuration but includes the use of two antennas having a different structure, for example, in terms of the material used, their shape, size and orientation with respect to each other and to the ground element. In this context it is proposed to provide an matching or adjusting network for adjustment of the electrical characteristics of the first antenna element to the second antenna element, as already indicated.

For instance, it is quite common for many handsets that the distance from the chassis to the formed surface of the front cover of the phone is smaller than the distance to the back surface of the phone. This sets the limit on the volume of the respective antenna element, which, in turn, determines the Q-factor. In order to provide similar or equal Q-factors, in such a case the structure of the antennas can be balanced to each other by variation of the shape, size and/or material of the respective antenna elements and by provision of a matching or adjusting network.

A simple and effective configuration of a mobile terminal, in particular mobile phone, according to the invention is provided by placing the first antenna element at the display side and the second antenna element at the back side of the mobile terminal. In that case, a first operation position is given when the display side of the mobile phone is facing the user and a second operation position is given when the back side of the mobile phone is facing the user.

Particular advantages can be realized upon combination of the invention with the antenna concept described in WO 2005/109570 A1 or variants thereof. Such antennas may appropriately be denoted as Dual-Patch Planar Inverted-L Antennas and provide advantages with respect to simplicity, bandwidth and ease of implementation. When applying this concept, it is preferable that at least one of the antenna elements is formed as such a Dual-Patch Planar Inverted L-Antenna. Additionally, by placement of the patches of the antenna element vertically to the ground element—instead of placing them in a planar arrangement—it becomes possible to place one of the antenna elements on the front side (display side) of the mobile phone without the requirement of any additional volume allocated for it. However, the invention is not limited to using this particular antenna concept. In fact, the invention works with various kinds of antennas.

The first antenna element and the second antenna element preferably are connected in parallel with each other. An intermediate matching element may be provided for connection, but the invention is not restricted to such a configuration and works without an intermediate matching element as well.

A mobile phone generally possesses a north or top end (the end of the phone where the speaker is disposed) and a south or bottom end (the end of the phone where to microphone is disposed). Preferably, the first antenna element and the second antenna element are disposed at the same end of north (top) end and south (bottom) end, to advantage e.g. at the south (bottom) end of the mobile phone.

BRIEF DESCRIPTION OF THE FIGURES

Features, embodiments and particular aspects of the invention are explained in the following with reference to the drawings.

DETAILED DESCRIPTION

Figure 1A:
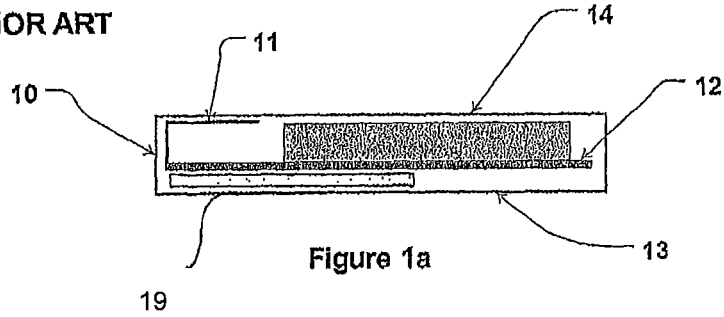
FIG. 1*a* shows a representative mobile phone according to the prior art.

A schematic structure of an embodiment of a mobile device of prior art is given in FIG. 1*a*. The mobile phone 10 comprises an antenna element 11, a chassis structure or ground element 12, and has two sides, namely the display side 13, which generally contains the user interface elements, and the antenna side 14, where the antenna element is located. The two sides may also be called the front side, and the back side, respectively. The phone has a casing or casing body 19.

Figure 1B:
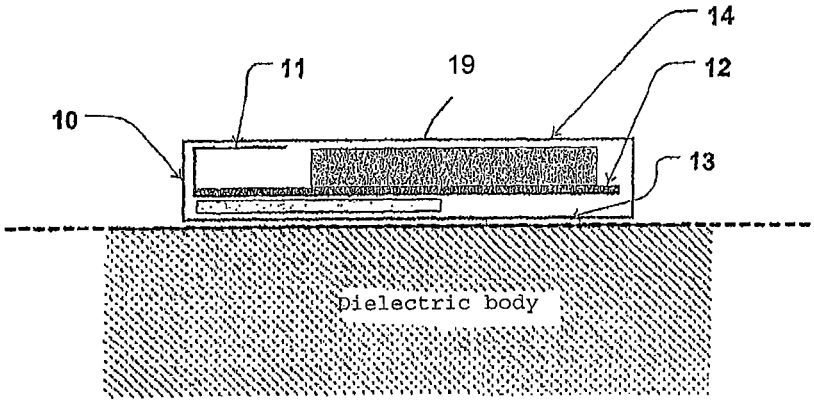
FIG. 1*b* shows the representative mobile phone of prior art disposed near a user, where the display side faces the dielectric body.

FIG. 1*b* shows a first operational position of the mobile phone 10, where the display side 13 of the device faces the body of the user. Since this operational position occurs for the normal talk position for the prior art, there have been proposed many solutions to reduce the SAR values for this user scenario.

Figure 1C:
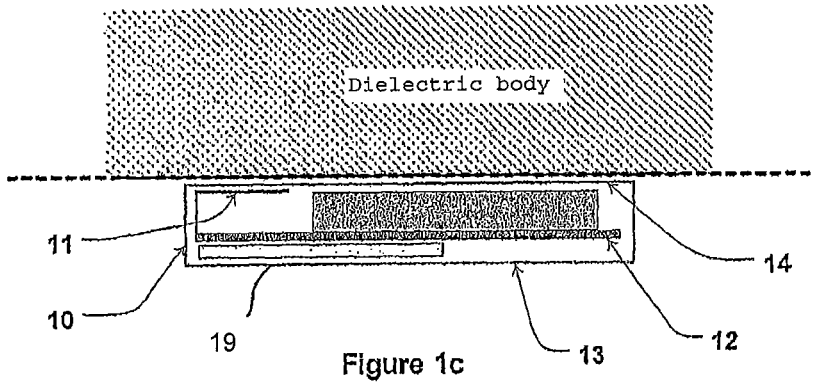
FIG. 1*c* shows the representative mobile phone of prior art disposed near a user, where the antenna side faces the dielectric body.

FIG. 1*c* shows a second operational position of the mobile phone 10, where the antenna side 14 of the device faces the body of the user. The earlier solution approaches targeted at the first operational position have little or no impact on the SAR values in this second scenario.

Figure 2A:
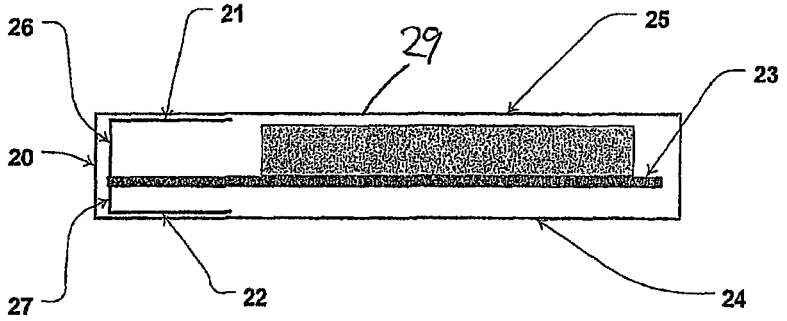
FIG. 2*a* shows a side view of a first embodiment of an antenna structure according to the invention.

FIG. 2*a* shows a first embodiment of the antenna arrangement according to the invention for the mobile device 20. The antenna arrangement comprises a main antenna or first antenna 21 and a complementary antenna or second antenna 22, which are positioned within a casing or casing body 29 on opposite sides of the chassis structure or ground element 23, namely, on the display (front) side 24 and the antenna (back) side, 25. A first feeding probe 26 for the main antenna 21 and a second feeding probe 27 for the complementary antenna 22 are provided for connecting the antennas to the feeding line present on the chassis for RF signal feed and reception. By this means the two antenna elements are connected with a common front end of high frequency circuitry of the mobile phone, possibly via a common impedance matching network associated to both antenna elements. The feeding probes may be connected to each other directly, to form a single antenna port, which is then connected to the main feeding line for RF signal feed and reception. Alternatively, they may be retained as two separate ports, which are connected to each other for example by means of an intermediate matching or adjusting circuit, which in turn is be connected to the main feeding line. Another possibility is that a matching or adjusting network or element is integrated in one or both of said feeding probes. The choice for the design of the combining/matching networks depends on the types of the antennas being used, and does not restrict the idea of the invention. In a physical implementation, it is possible to build the combining/matching/adjusting networks or elements onto the PCB/PWB, or to integrate the combining/matching networks within the antenna structures.

Figure 2B:
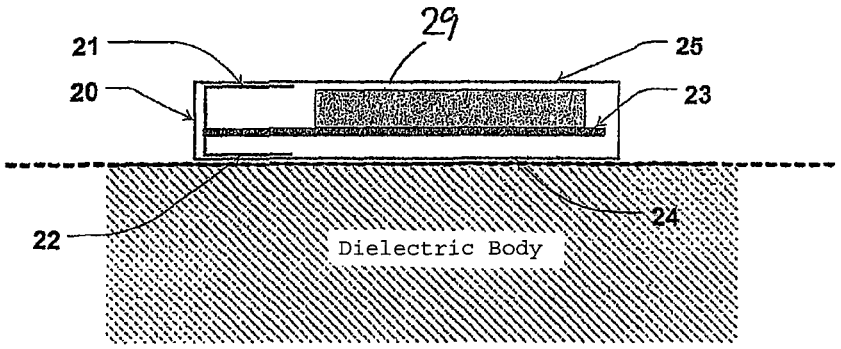
FIG. 2*b* shows a side view of a first embodiment of an antenna structure according to the invention disposed near a user, where the display side faces the dielectric body.

The antenna arrangement according to the invention operates in a dynamic way so as to adjust to the surroundings of the mobile device. If the mobile device 20 is placed in free space, both the main and the complementary antenna will operate together, radiating into the free space. However, if the device is disposed near to a user's body such that the display side 24 faces the body, as shown in FIG. 2*b*, then the complementary antenna 22 undergoes dielectric loading by the (dielectric) body of the user, and thus gets de-tuned. Conversely, the main antenna element 21, which is shielded away from the user, is not significantly influenced by the presence of the body. Consequently, for this scenario, the main antenna overshadows the complementary antenna in terms of radiation performance, and as the main antenna is shielded away from the user by means of the chassis 23, which acts as an electrical ground element, the electromagnetic energy radiates away from the user's body, resulting in low RFEMF exposure.

Figure 2C:
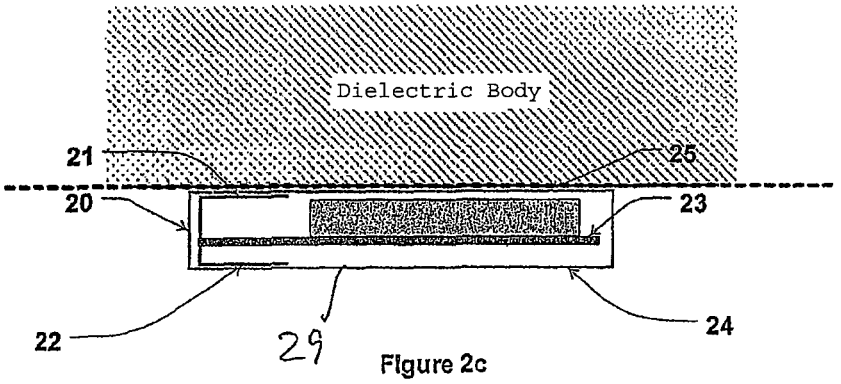
FIG. 2*c* shows a side view of a first embodiment of an antenna structure according to the invention disposed near a user, where the antenna side faces the dielectric body.

Similarly, if the device is disposed near to a user's body such that the antenna side 25 faces the body, as shown in FIG. 2*c*, then the main antenna 21 undergoes dielectric loading, and thus gets de-tuned. Conversely, the complementary antenna element 22, which is shielded away from the user, is not significantly influenced by the presence of the (dielectric) body. Consequently, for this scenario, the complementary antenna overshadows the main antenna in terms of radiation performance, and as the complementary antenna is shielded away from the user by means of the chassis 23, which acts as an electrical ground element, the electromagnetic energy radiates away from the user's body, resulting again in low RFEMF exposure of the user.

Figure 3A:
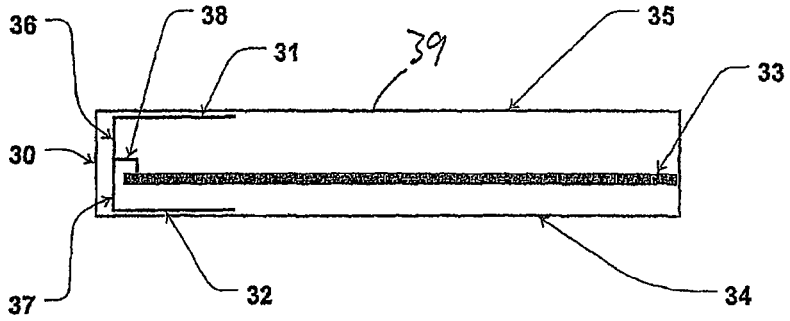
FIG. 3*a* shows a side view of a second embodiment of an antenna structure according to the invention.
Figure 3B:
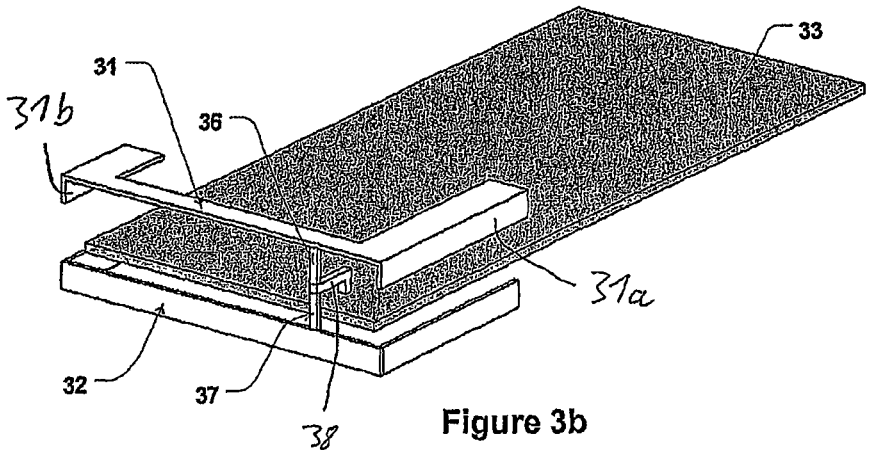
FIG. 3*b* shows an additional view of a second embodiment of an antenna structure according to the invention.

In FIG. 3*a* and FIG. 3*b*, a further embodiment of the antenna arrangement according to the invention is shown. In this embodiment, the antenna types for the main antenna and the complementary antenna are chosen as variants of the antenna structure described in WO 2005/109570 A1. FIG. 3*a* shows the device chassis 33, the main or first antenna 31, and the complementary or second antenna 32. The main antenna feeding probe 36 and the complementary antenna feeding probe 37 are directly connected to each other, and then connected to the feeding line for RF signal feed and reception by means of a third probe 38, combining the other two probes. In this way, a unified single port is formed for the two antennas. Many such different feeding arrangements are possible within the context of the implementation, which depend on the specific design of a given device; nonetheless, the principle of the invention is not limited by those.

FIG. 3*b* shows a representative illustration for the arrangement of the structure shown in FIG. 3*a*, which is provided inside the casing or casing body 39 of the mobile handset 30.

FIG. 3*b* is an example for an embodiment, where the electrical characteristics of the two antenna elements have been adjusted to become similar to each other. This is achieved by providing vertical flaps 31*a* and 31*b* to the main antenna 31, which has larger volume and thus a lower capacitive coupling to the chassis, in order to increase its capacitive coupling to the chassis 33. Further, the other antenna element 32, which has a smaller volume and thus a higher capacitive coupling to the chassis has been provided in the form of a vertical patch arrangement, in order to reduce the capacitive coupling to the chassis. Further, the feeding structure is arranged in such a way that the respective feeding probes 36 and 37 have similar electrical lengths between the respective antenna element and a branching point of the common probe 38, so that the antenna elements are fed in-phase. In FIG. 3*b* the probes 36, 37 and 38 are shown as being formed by individual elements connected with each other. However, it is generally preferred that these three probes are provided integrally as sections of one common feed element.

This embodiment shown in FIG. 3*a* and FIG. 3*b* provides advantages with regard to simplicity, bandwidth and ease of implementation as compared to antenna configurations known in the art. By the use of this arrangement as shown in FIG. 3*a* and FIG. 3*b*, the maximum user exposure to electromagnetic fields radiated from the handset, and thereby the SAR values can be reduced significantly, compared to mobile devices known from the art which involve only a single antenna. In addition, the embodiment according to the invention provides enhancements in the radiation performance of the mobile device.

As a further advantage, the placement of at least some of the elements vertically to the chassis, instead of aligning them in a planar arrangement, makes it possible to place the second antenna element on the front side of the mobile phone without requiring any additional volume for arranging it. As a result, the second antenna introduced by the concept of the arrangement of antenna elements according to the invention does not require a significant additional volume for mounting the antenna structure.

Figure 4A:
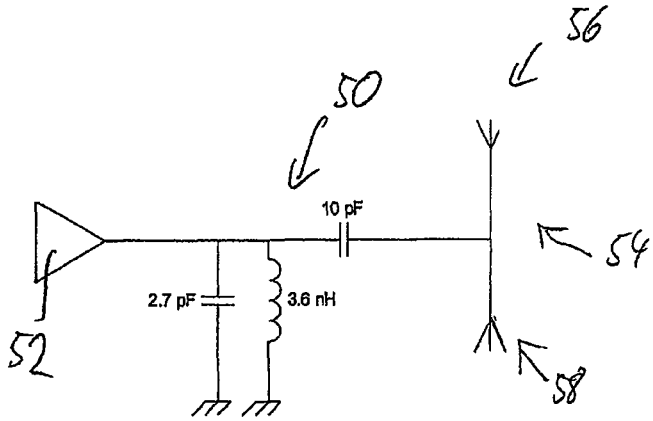
FIG. 4*a* shows an example of a common matching circuit associated to a first and a second antenna element connected in parallel.
Figure 4B:
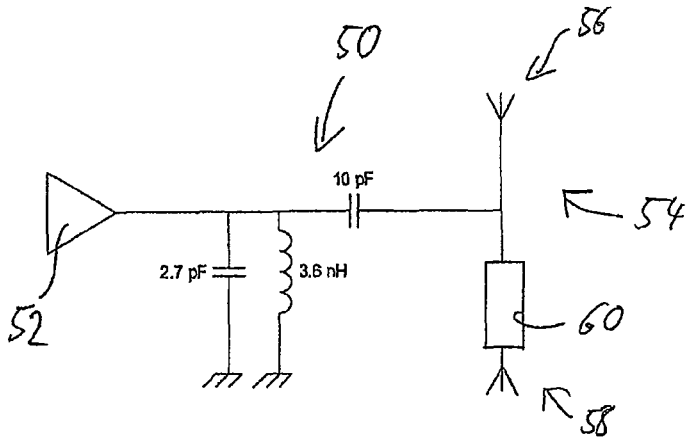
FIG. 4*b* shows the arrangement according to FIG. 4*a* having an additional delay element associated to one of the antenna elements.

FIGS. 4*a* and 4*b* show an example for a common matching circuit or matching network 50 arranged between an RF front-end module 52 and the antenna arrangement 54 having a first antenna element 56 (e.g. of the kind of the antenna element 31 of FIG. 3*b*) and a second antenna element 58 (e.g. of the kind of antenna element 32 of FIG. 3*b*). In case of FIG. 4*a* the two antenna elements are connected directly in parallel, with the combined feeding being preferably arranged in such a way that the electrical lengths of the feeding probes of the respective antenna elements are similar to each other, as in the case of FIG. 3*b*.

In contrast to this arrangement, the arrangement according to FIG. 4*b* relies on a delay element 60, which is added to that antenna element that leads the other antenna element in phase, in order to ensure that the two antennas are fed in-phase. One may of course combine the approaches "adjustment of the lengths of the feed probes" and "delay element or delay network". An appropriate delay element can for example be provided in the form of a simple transmission line placed on or above the chassis, or it may be designed as a network of lumped components.

Figure 5:
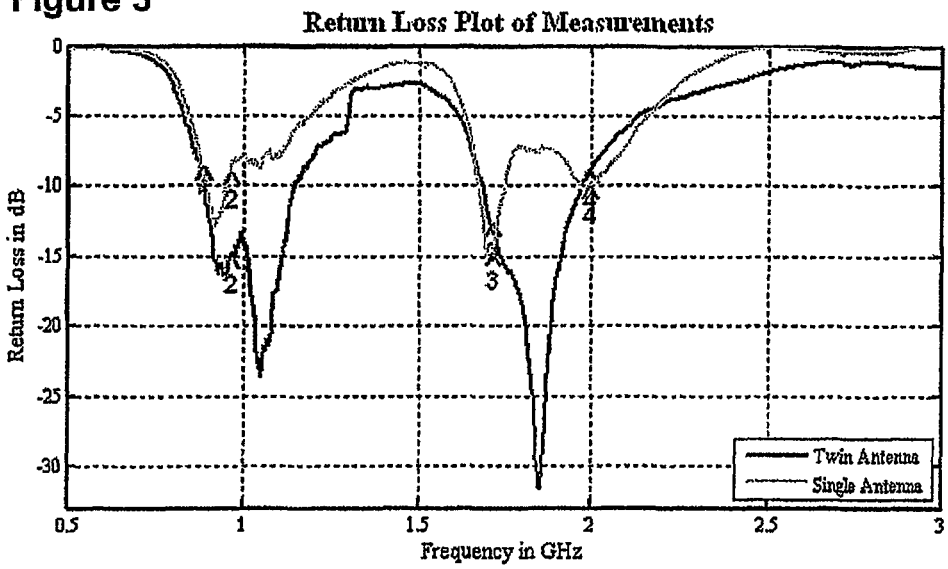
FIG. 5 shows return loss measurements comparing an implementation of a twin antenna arrangement according to the invention with a reference single antenna.

FIG. 5 shows a return loss plot of measurements comparing an implementation of the twin antenna concept of the invention with a reference single antenna. Due to a better coupling of the antenna arrangement of the invention to the chassis of the phone, a bandwidth enhancement is observed in the lower frequency range, where the chassis acts as the main radiator.

Figure 6:
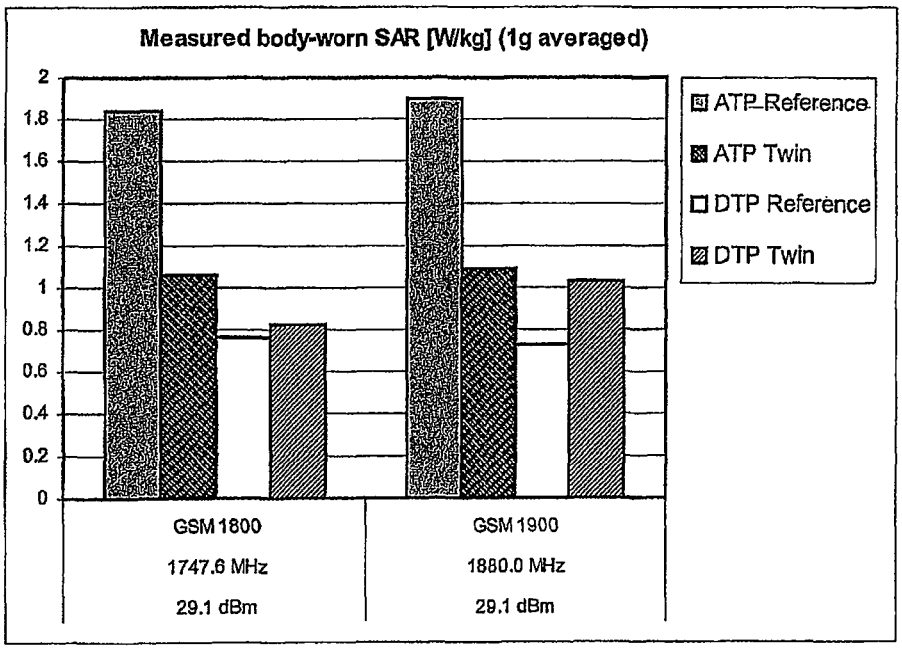
FIG. 6 shows measured body-worn SAR values for the twin antenna and the reference antenna.

FIG. 6 shows exemplarily measured body-worn SAR values for a twin antenna arrangement according to the invention in comparison to corresponding SAR values for a reference single antenna. The acronyms "ATP" and "DTP" designate the antenna-to phantom and display-to phantom scenarios, respectively, the phantom representing the body a user. All plotted data are shown normalized with respect to the measured efficiency values of the twin antenna set-up. The plot shows that the twin antenna makes it possible to reduce the overall maximum SAR values to a significant extent.

Figure 7A:
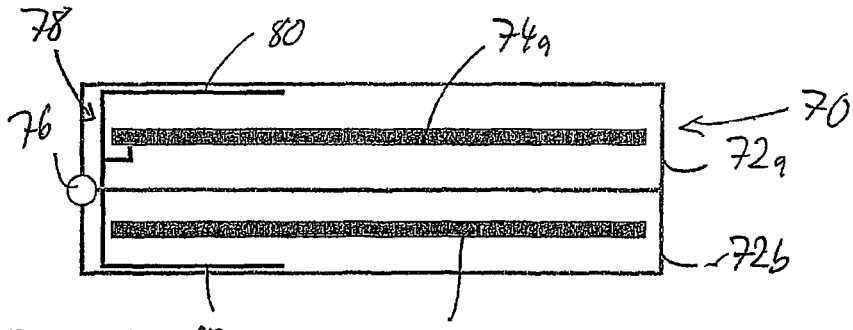
FIG. 7*a* shows a first embodiment showing an example for implementing the invention in a mobile terminal of the clam-shell or folder type.
Figure 7B:
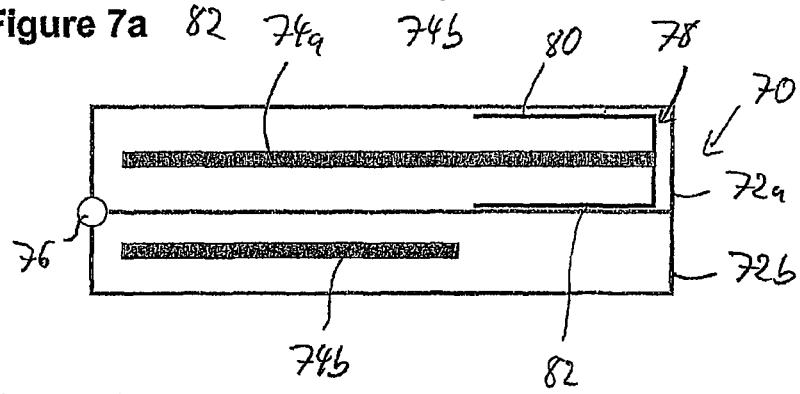
FIG. 7*b* shows a second embodiment showing another example for implementing the invention in a mobile terminal of the clam-shell or folder type.

FIGS. 7*a* and 7*b* show two examples for a phone of the clam-shell or folder type. The phone 70 has a first body 72*a* and a second body 72*b*, in which a respective conducting chassis part or ground plane 74*a* and 74*b*, respectively, are provided. A hinge mechanism 76 allows a folding or swiveling movement between the two bodies. According to the example of FIG. 7*a* the antenna arrangement 78 is provided with its first antenna element 80 in body 72*a* and with its second antenna element 82 in body 72*b*, so that in the closed position according to FIG. 7*a* the two antenna elements 80 and 82 are arranged on opposite sides of the two chassis parts 74*a* and 74*b*. A feeding junction between the two antenna elements can be bent so that it can follow the relative folding movement between the two bodies provided by the hinge mechanisms 76.

As shown in FIG. 7*a*, the antenna arrangement follows the principle of the antenna arrangement shown in FIG. 3*a*. Preferably, additionally a delay element associated to the antenna element 80 is provided, to equalize the electrical phases of the two antenna elements.

FIG. 7*b* shows an antenna arrangement 78 which has both antenna elements 80 and 82 located in the first casing 72*a*. Accordingly, the situation is basically as in the embodiment of FIG. 2*a*, except for the additional second body 72*b* and the hinge mechanism 76.

Figure 8A:
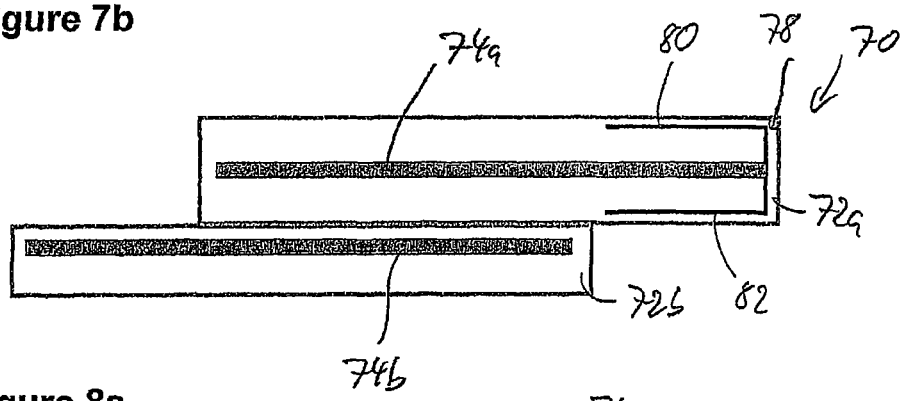
FIG. 8*a* shows a first embodiment showing an example for an implementation of the invention in a mobile terminal of the slider type.
Figure 8B:
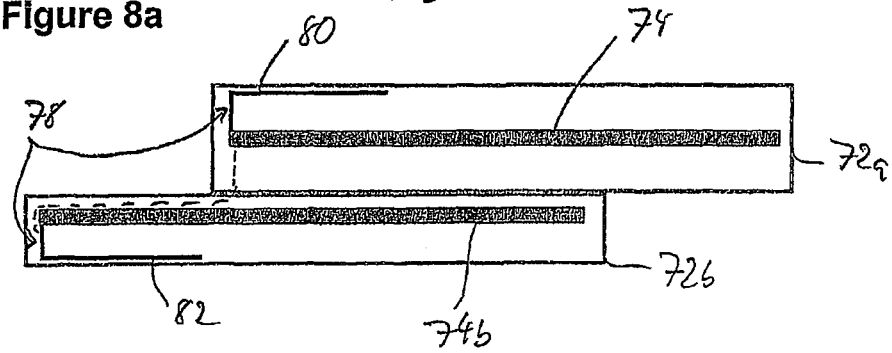
FIG. 8*b* shows a second embodiment showing a further example for an implementation of the invention in a mobile terminal of the slider type.

FIG. 8*a* and FIG. 8*b* show embodiments of mobile phones of the so-called slider type. For simplicity the same reference signs as in FIG. 7*a* and FIG. 7*b* are used. The phone 70 has a first body 72*a* and a second body 72*b* which are connected by a sliding mechanism which allows a sliding movement between the two bodies. Each body has a conducting chassis part or ground plane 74*a* and 74*b*, respectively. According to FIG. 8*a*, the antenna arrangement 78 is provided with its two antenna elements 80 and 82 in the first body 72*a*, so that a similar situation is achieved in the embodiment of FIG. 2*a*, except for the additional body 72*b*.

According to FIG. 8*b*, the antenna arrangement 78 has its first antenna element 80 in the first body and the second antenna element 82 in the second body 72*b*. The two antenna elements are connected by a feeding junction arrangement which allows the shifting movement between the two bodies. This feeding junction arrangement is represented functionally by dashed lines.

Summarizing the above, a mobile terminal, e.g. mobile phone, having an antenna structure according to the invention enables the reduction of the overall maximum SAR values, exhibits an enhanced operational bandwidth and is suitable for miniaturization of the overall mobile handset.

While the invention has been described with reference to different embodiments above, this description shall not limit the disclosure of features and aspects of the present invention. In this regard, as far as modifications are readily apparent for an expert skilled in the art they shall be included by the above description of embodiments implicitly. For example, while the antenna structures of FIGS. 2 and 3 have been described, it is also possible to provide an arrangement of the first and the second antenna element extending beyond the chassis. By this means an increased coupling between the antenna arrangement and the chassis can be achieved, with corresponding positive effect on the usable reception and transmission bandwidth.

Furthermore, the invention is not limited to the described embodiments above and modifications can be performed easily, even beyond the subject matter of possible combinations of features and structures described above. For example, while the present embodiments have been described with reference to antenna elements comprising substantially equal or quite similar electrical characteristics, the invention is not limited to such a configuration but also includes configurations of mobile phones where an impedance matching network is provided to balance the electrical properties of antenna elements which are different in view of their geometrical dimensions.

For a mobile terminal for receiving wireless transmissions from a transmitter and transmitting wireless transmissions to a receiver it proposed to provide an antenna arrangement having a plurality of antenna elements each provided on or within a common body or a respective body of the terminal in a defined spatial relation to a conducting chassis part, wherein at least one first antenna element is located on a first side and at least one second antenna element is located on a second side of the same conductive chassis part or of the respective conducting chassis part, wherein high frequency circuitry, for transmitting a respective wireless transmission, is adapted to simultaneously drive said first antenna element and said second antenna element by feeding the same or corresponding high frequency signals to said first antenna element and to said second antenna element.

It should be understood that various changes and modifications to the presently preferred embodiments described herein will be apparent to those skilled in the art. Such changes and modifications can be made without departing from the spirit and scope and without diminishing its intended advantages. It is therefore intended that such changes and modifications be covered by the appended claims.

The invention claimed is:

1. Mobile terminal for receiving wireless transmissions from a transmitter and transmitting wireless transmissions to a receiver, in particular for use in a wireless telecommunication system, comprising:

a casing with at least one body, said body having a conducting chassis part and electronic means, said body further having a first surface located on a first side of its conducting chassis part and a second surface located on a second side of its conducting chassis part;

an antenna arrangement provided on or within said body, said antenna arrangement together with associated high frequency circuitry or said antenna arrangement together with said conducting chassis part and associated high frequency circuitry being adapted to receiving wireless transmissions and transmitting wireless transmissions in at least one predetermined frequency band;

said antenna arrangement has a plurality of antenna elements each provided on or within said body in a defined spatial relation to its conducting chassis part, wherein at least one first antenna element is located on the first side of the conducting chassis part and at least one second antenna element is located on the second side of the conducting chassis part;

said high frequency circuitry, for transmitting a respective wireless transmission, being adapted to simultaneously drive said first antenna element and said second antenna element by feeding the same or corresponding high frequency signals to said first antenna element and to said second antenna element; and a control unit to determine which of the antenna elements is farthest away from a user and which controls a switching arrangement to use only that antenna element located farthest away from the user for transmissions.

2. Mobile terminal for receiving wireless transmissions from a transmitter and transmitting wireless transmissions to a receiver, in particular for use in a wireless telecommunication system, comprising:

a casing with a first body and a second body, each body having a conducting chassis part and electronic means, each body having a first surface located on a first side of its conducting chassis part and a second surface located on a second side of its conducting chassis part;

a relative movement mechanism linking the first body and the second body and allowing a relative movement between the two bodies between a plurality of operational relative positions, wherein at least in a closed operational relative position the second surface of the first body faces and covers at least partially the first surface of the second body;

an antenna arrangement provided on or within at least one associated of said bodies, said antenna arrangement together with associated high frequency circuitry or said antenna arrangement together with said conducting chassis part and associated high frequency circuitry being adapted to receiving wireless transmissions and transmitting wireless transmissions in at least one predetermined frequency band;

said antenna arrangement has a plurality of antenna elements each provided on or within an associated of said bodies in a defined spatial relation to its conducting chassis part, wherein at least one first antenna element is located on the first side of the conducting chassis part of the first body and at least one second antenna element is located on the second side of the conducting chassis part of the first body or of the second body;

said high frequency circuitry, for transmitting a respective wireless transmission, being adapted to simultaneously drive said first antenna element and said second antenna element by feeding the same or corresponding high frequency signals to said first antenna element and to second antenna element; and a control unit to determine which of the antenna elements is farthest away from a user and which controls a switching arrangement to use only that antenna element located farthest away from the user for transmissions.

3. Mobile terminal according to claim 1, wherein the high frequency characteristics of the first and second antenna elements in said predetermined frequency band are adjusted or matched such to one or more of each other and to the high frequency characteristics of the high frequency circuitry that under free space conditions a first substantial portion of the high frequency power associated to said wireless transmissions is radiated via the first antenna element and a second substantial portion of the high frequency power associated to said wireless transmissions is radiated via the second antenna element and that under asymmetric non free space conditions, when only a selected one of the first and second antenna elements is dielectricly loaded or a selected one of the first and second antenna elements is dielectricly loaded stronger than the other of the first and second antenna elements, the portion of the high frequency power associated to said wireless transmissions which is radiated via said selected antenna element is reduced with respect to the free space conditions, so that of the overall high frequency power radiated via the first and second antenna elements the relative portion which is radiated via the selected antenna element under the asymmetric non free space conditions is decreased with respect to the free space conditions.

4. Mobile terminal according to claim 3, wherein said asymmetric non free space conditions relate to conditions under dielectric loading of said selected antenna element by the body of the user, the selected antenna element being that antenna element of said first and second antenna elements which is nearer to the body of the user depending whether the first or second side is directed to the body of the user.

5. Mobile terminal according to claim 1, wherein said first and second antenna elements are connected in parallel with a common feeding point, directly or via a common matching network, the common feeding point being provided by an output port of a common front end of said high frequency circuitry.

6. Mobile terminal according to claim 5, wherein said first and second antenna elements share a common feeding line connecting the feeding point or an output port of the common matching network with a feeding junction connecting the first and second antenna elements directly or via at least one matching or adjusting network associated to a respective of the first and second antenna elements.

7. Mobile terminal according to claim 6, wherein a branching point at which the common feeding line is connected with the feeding junction is located on the conducting chassis part having the common front end.

8. Mobile terminal according to claim 6, wherein a branching point at which the common feeding line is connected with the feeding junction is displaced from the conducting chassis part having the common front end.

9. Mobile terminal according to claim 1, wherein said first and second antenna elements are connected individually with a respective first and second front end of said high frequency circuitry, directly or via a respective matching network, said front ends being operable to drive the first and second antenna elements in parallel by feeding the same or corresponding high frequency signals to said first antenna element and to second antenna element.

10. Mobile terminal according to one claim 1, the antenna arrangement being provided with or having associated means to equalize or reduce comprising one or more of: a difference between electrical characteristics of the first and second antenna elements, a first and second high frequency coupling between the conducting chassis part and the first antenna element and the second antenna element, respectively, and phases of currents associated to the first and second antenna elements.

11. Mobile terminal according to claim 1, wherein at least one of the antenna elements is provided in the form of a patch antenna element, wherein at least one vertical patch antenna section is provided in order to increase or decrease the coupling to the associated conducting chassis part.

12. Mobile terminal according to claim 1, wherein at least one of the antenna elements is provided with a horizontal patch antenna section.

13. Mobile terminal according to claim 1, wherein at least one of the antenna elements is provided with or has associated a delay element or delay network in order to increase an effective electrical length relevant for the feeding and influencing the phase of currents associated to the respective antenna element.

* * * * *

UNITED STATES PATENT AND TRADEMARK OFFICE

CERTIFICATE OF CORRECTION

PATENT NO. : 8,537,057 B2
APPLICATION NO. : 12/914738
DATED : September 17, 2013
INVENTOR(S) : Alexander Friederich et al.

It is certified that error appears in the above-identified patent and that said Letters Patent is hereby corrected as shown below:

In the Claims

In column 16, line 24, in Claim 10, delete “to one” and insert -- to --, therefor.

Signed and Sealed this
Twelfth Day of May, 2015

Michelle K. Lee

Michelle K. Lee
*Director of the United States Patent and Trademark Office*